United States Patent [19]

Smith

[11] 4,257,436

[45] Mar. 24, 1981

[54] COIN DISPENSING APPARATUS HAVING A U-SHAPED COIN EJECTOR

[75] Inventor: Barry L. Smith, Florissant, Mo.

[73] Assignee: UMC Industries, Inc., Stamford, Conn.

[21] Appl. No.: 60,465

[22] Filed: Jul. 25, 1979

[51] Int. Cl.[3] ..... G07D 1/00

[52] U.S. Cl. ..... 133/5 R

[58] Field of Search ..... 221/274, 129; 133/4 R, 133/4 A, 5 R

[56] References Cited

U.S. PATENT DOCUMENTS

| | | | |
|---|---|---|---|
| 2,763,272 | 9/1956 | Patzer | 133/4 R X |
| 3,000,539 | 9/1961 | Danziger et al. | 221/129 |
| 3,935,873 | 2/1976 | Johnson | 133/5 R |

*Primary Examiner*—Stanley H. Tollberg

*Attorney, Agent, or Firm*—Senniger, Powers, Leavitt & Roedel

[57] ABSTRACT

Coin dispensing apparatus comprising a base having a socket therein adjacent one end of the base constituting its rearward end, a coin ejector at the bottom of the socket movable forward away from a retracted position for ejecting a coin in the socket, the ejector being movable forward to eject the coin and rearward back to a retracted position. The socket is adapted to receive a coin tube for holding a stack of coins, the bottom coin bearing on the bottom of the socket. The socket has an exit passage at the forward end for ejection of the coin by sliding it forward off the bottom of the socket. The bottom of the socket has a forward edge and an opening adjacent the rearward side of the socket. A central slot extends in the bottom of the socket between its opening and the forward edge. The ejector comprises a U-shaped member opening toward the forward end of the base and has an upstanding T-shaped projection at a central portion of its closed end. The projection is engageable with the rearward edge of the bottom coin and comprises a head at the upper end of a stem which head is above the bottom of the socket, when the ejector moves forward, and below the bottom of the socket, when the ejector moves rearward. The U-shaped member at its open end is wider than the coin to be ejected.

16 Claims, 7 Drawing Figures

COIN DISPENSING APPARATUS HAVING A U-SHAPED COIN EJECTOR

BACKGROUND OF THE INVENTION

This invention relates to coin dispensing apparatus, and more particularly to coin dispersing apparatus having a movable coin ejector.

The invention involves an improvement upon the coin dispensing apparatus of the type such as shown in U.S. Pat. No. 3,935,873 comprising a base having a socket therein adjacent one end of the base constituting its rearward end, a coin ejector at the bottom of the socket movable in a forward direction away from a retracted position for ejecting a coin in the socket, and means for moving the ejector forward to eject the coin and rearward back to its retracted position. The movable coin ejector comprises a ring shaped member having an upstanding projection at the rearward end thereof engageable with the rearward edge of the coin to be ejected for moving the coin forward to eject it. In a subsequent version of this type of prior art dispenser, a head was incorporated on the upper end of the projection so that a portion of the projection would remain above the bottom of the socket and in engagement with the edge of the coin as the ejector moved forward.

SUMMARY OF THE INVENTION

Among the several objects of this invention may be noted the provision of a coin dispensing apparatus which operates without jamming; the provision of such apparatus which is adapted to receive any one of a number of coin tubes of different internal diameters for holding coins of different denominations; the provision of such apparatus in which "rim lock" of the coins held in the coin tube is prevented; and the provision of such apparatus in which the coins can not be shaken out of the apparatus.

Briefly, the coin dispensing apparatus of this invention comprises a base having a socket therein adjacent one end of the base constituting its rearward end. The socket is adapted to receive a coin tube for holding a stack of coins to be dispensed, the bottom coin of the stack bearing on the bottom of the socket for supporting the stack of coins. The socket at its forward side has an exit passage for ejection of the bottom coin by sliding it forward off the bottom of the socket. The bottom of the socket has a forward edge at the forward side of the socket and an opening adjacent the rearward side of the socket. A central slot narrower than the opening extends from the opening to the forward edge of the bottom of the socket. The base has a bottom-opening recess forward of the socket into which the bottom coin slides as it is ejected. The coin, upon being ejected, drops down out of the recess. The dispensing apparatus further comprises a coin ejector at the bottom of the socket movable forward away from a retracted position for ejecting the bottom coin, and means for moving the ejector forward to eject the coin and rearward back to its retracted position. The ejector comprises a U-shaped member opening toward the forward end of the base and having an upstanding T-shaped projection at a central portion of its closed end. The projection is engageable with a rearward edge of the bottom coin and comprises a stem adapted to extend up within the central slot, and a head at the upper end of the stem. The head is disposed above the bottom of the socket when the ejector moves forward, and below the bottom of the socket when the ejector moves rearward. The U-shaped member at its open end is wider than the coin to be ejected.

Other objects and features will be in part apparent and in part pointed out hereinafter.

DESCRIPTION OF THE PREFERRED EMBODIMENT

Figure 1:
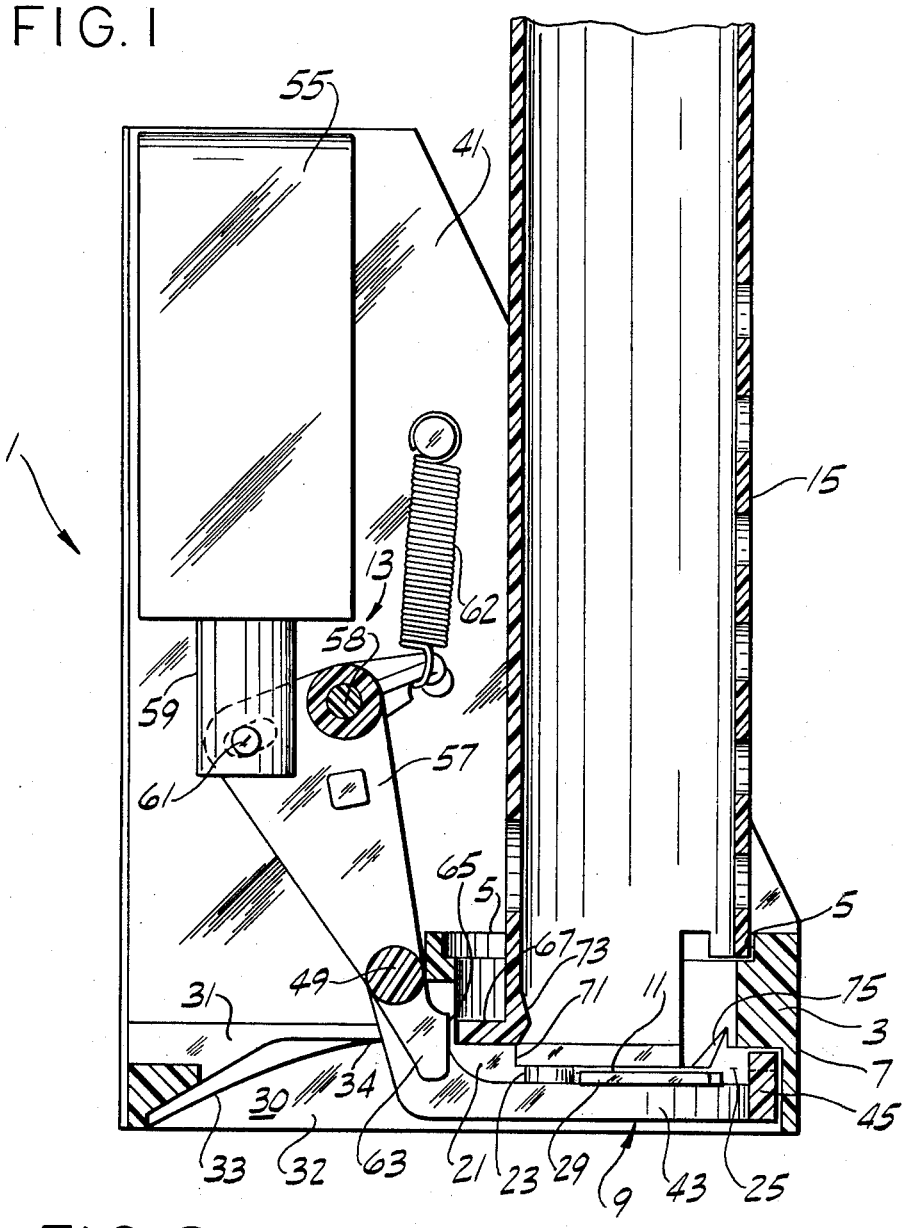
FIG. 1 is a section of a coin dispensing apparatus of this invention showing a coin ejector in a retracted position.

Referring to the drawings, there is generally indicated at 1 coin dispensing apparatus of this invention comprising a base 3 having a socket 5 therein adjacent one end of the base constituting its rearward end 7, a coin ejector 9 at the bottom 11 of the socket 5 movable forward away from a retracted position at the rearward end 7 of the base 3 for ejecting a coin, and means 13 for moving the ejector 9 forward for ejecting the coin and rearward back to its retracted position.

In particular, the socket 5 is adapted to receive a coin tube 15 for holding a stack 17 of coins to be dispensed. The bottom coin 19 of the stack bears on the bottom 11 of the socket 5 for supporting the stack of coins. An exit passage 21 is provided at the forward side of the socket for ejecting the bottom coin 19 by sliding it forward over the bottom 11 of the socket 5 past forward edge 23 of the bottom 11. The bottom of the socket has an opening 25 adjacent the rearward end 7 of the socket, and a central slot 27 narrower than the opening 25 extending between the opening 25 and the forward edge 23 of the bottom 11 of the socket (see FIG. 2). A pair of ejector guides 29 extend from the bottom 11 of the socket 5 and define the sides of the slot 27.

Figure 4:
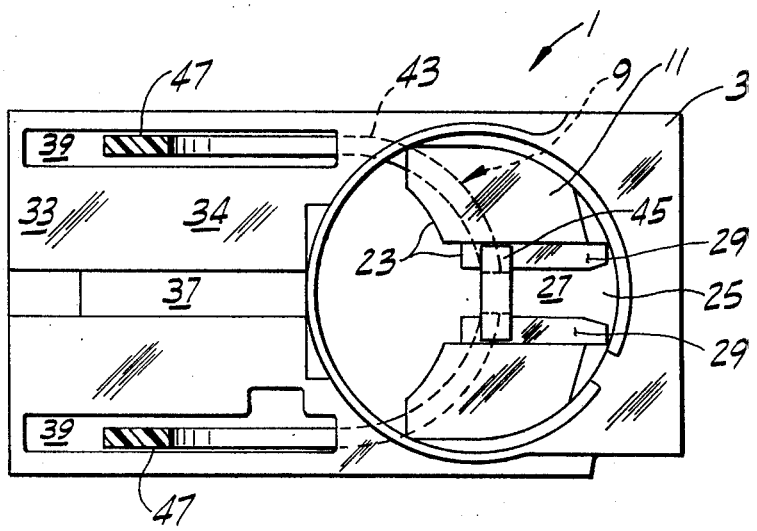
FIG. 4 is a plan with parts removed showing the ejector in the forward position.

The base 3 has sides 30 and a top 31 which together define a bottom-opening recess 32. The top 31 has an inclined surface 33 at the forward end of the base 3 engageable by the forward edge of the coin 19 for deflecting the coin downwardly and a generally horizontal surface 34 extending from the exit passage 21 forwardly to the inclined surface 33 (see FIGS. 2 and 4). The top 31 also has a centrally disposed slot 37 and slots 39 at the sides 30 of the base 3. Extending up from the base at one side 30 is a side plate or wall 41.

The ejector 9 comprises a U-shaped member 43 opening toward the forward end of the base 3 and having an upstanding T-shaped projection 45 at a central portion of its closed end. A pair of arms 47 at the open end of the member 43 each extend upwardly from the U-shaped member 43 side slots 39 in the top 31. The T-shaped projection 45 engages the rear of the bottom coin 19 when the ejector 9 is moved forward to eject the coin. The open end of the U-shaped member 43 is wider than the bottom coin 19, so that the coin can be moved into engagement with the inclined surface 33 of the top of the base and be deflected downwardly by the top 31 without the coin 19 becoming jammed between the U-shaped member 43 and the inclined surface 33. Both arms 47 are pivotally connected to pins 49 extending horizontally from the means 13 for moving the ejector 9. One of the arms 47 has a finger 51 extending horizontally above the pins 49. This finger 51 is engageable by a hairpin spring 53 secured to the means 13 for moving the ejector 9 for biasing the ejector to a predetermined angular position relative to the means 13 for moving the ejector 9.

The means 13 for moving the ejector 9 comprises a solenoid 55 secured to the side plate 41 and a crank 57 pivotally mounted on a horizontal pin 58 extending from the side plate 41 for pivotal movement forward away from a retracted position. The plunger 59 of the solenoid 55 is connected to the crank 57 by means of a pin and slot arrangement 61. Upon energization of the solenoid, the plunger 59 moves upwardly thereby pivoting the crank 57 forward, thus moving the ejector 9 forward to eject the bottom coin 19. A tension spring 62 secured at one end thereof to the plate 41 and to the crank 57 at its other end biases the crank rearwardly to its retracted position and the ejector 9 to its retracted position. The crank 57 further comprises a lug 63 extending down below the pin 49 into the centrally disposed slot 37 in the top 31. The rearward edge 65 of the lug 63 is positioned at the exit passage 21 of the socket 5, when the crank 57 is in its retracted position, so as to be engageable with the forward edge of the bottom coin 19, and thus act as a stop in preventing the bottom coin 19 from being shaken out of the socket 5. The lug 63 moves forward with the crank 57 to unblock the exit passage 21 as the ejector 9 is moved forward to eject the bottom coin 19.

Figure 3:
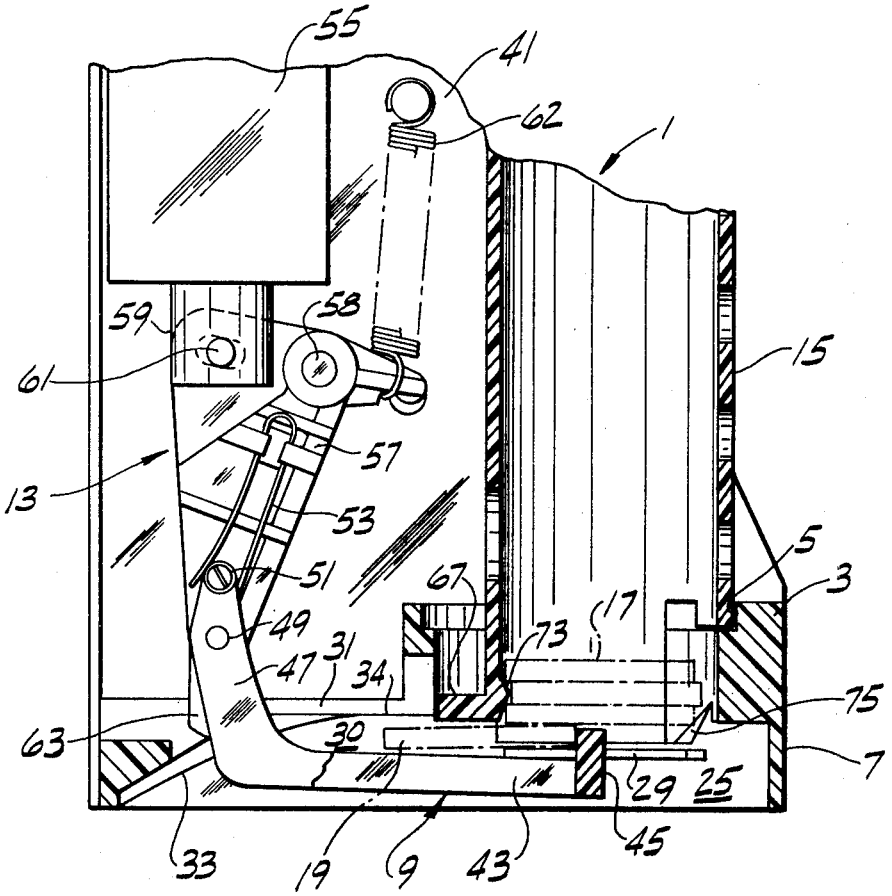
FIG. 3 is a section similar to FIG. 1 showing the ejector in a forward position.
Figure 5:
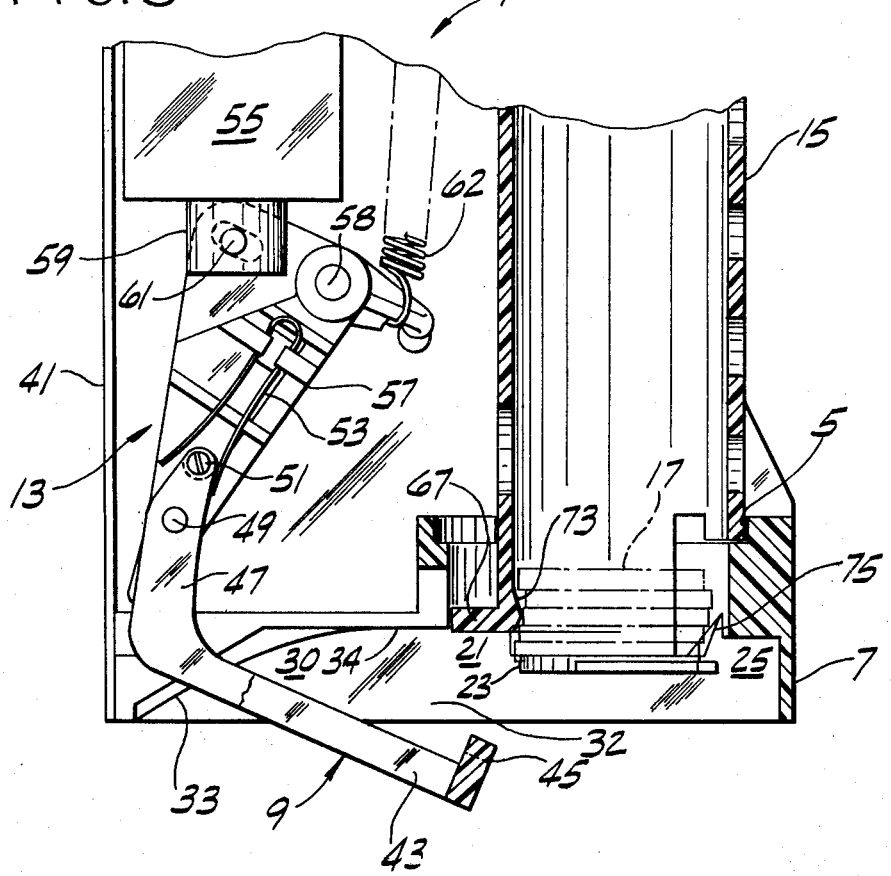
FIG. 5 is a section similar to FIG. 3 showing the ejector in its forwardmost position.
Figure 6:
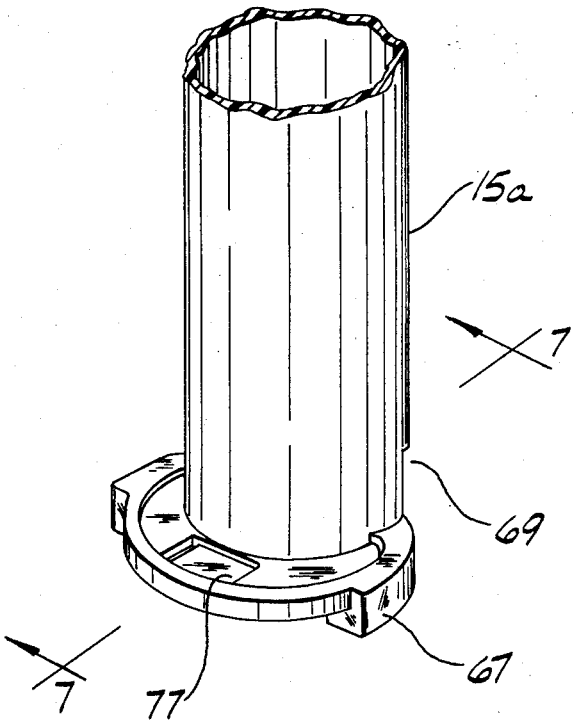
FIG. 6 is a perspective of a coin tube for small-diameter coins.
Figure 7:
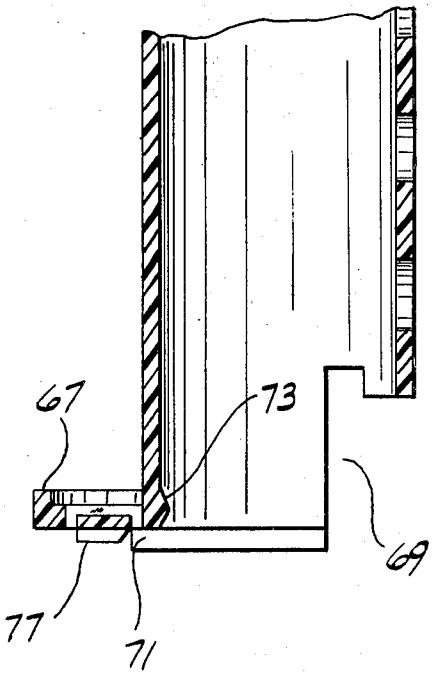
FIG. 7 is a partial section on line 7—7 of FIG. 6.

The coin tube 15 is one of a number of tubes of different internal diameters for holding coins of different diameters (e.g., the coin tube 15 shown in FIGS. 1, 3 and 5 is adapted to hold a stack 17 of coins of a relatively large diameter, such as quarters, while the coin tube 15A shown in FIGS. 6 and 7 is adapted to hold a stack 17 of relatively small-diameter coins, such as dimes). Both coin tubes 15 and 15A have means 67 interengaging with the socket 5 for holding the lower end of the coin tube in the socket with the rear of the stack 17 of coins at the opening 25 at the rearward side of the socket 5. In addition, each coin tube has at its lower end, toward its rearward side, an opening 69 sized to enable the T-shaped projection 45 to move therethrough and, toward its forward side, an opening 71 sized to enable the bottom coin 19 and the T-shaped projection to move therethrough. To prevent "rim lock" of the rims of the bottom coin 19 and the coin immediately above it, the coin tube and the socket 5 have means for positioning the forward edge of the bottom coin 19 slightly forward of the coin above it. The positioning means comprises a projection 73 on the interior surface of the coin tube 15 having two inclined surfaces that meet at an apex and an inclined projection 75 at the rearward side of the socket 5. To assist the lug 63 in preventing coins from being shaken out of the socket 5, the coin tube, particularly a coin tube adapted to hold small diameter coins, may have a spring finger 77 at its lower end for bearing down on the top of the bottom coin 19. The finger 77 extends down into the exit passage 21 of the socket 5 so that, if the bottom coin 19 were to be shaken forward across the bottom 11 of the socket 5, the finger 77 would engage the bottom coin and prevent the bottom coin from entering the exit passage 21.

Figure 2:
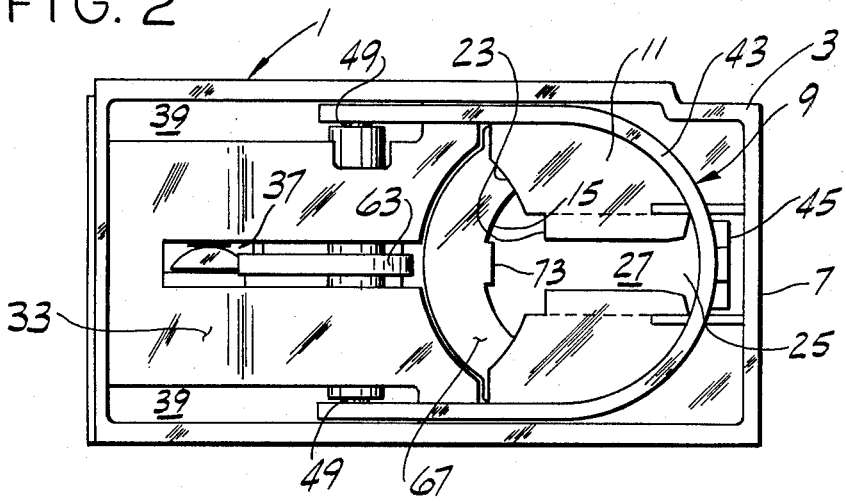
FIG. 2 is a bottom plan showing the ejector in its retracted position.

In operation, the tension spring 62 biases the crank 57 rearwardly to its retracted position and the ejector 9 rearwardly to its retracted position (see FIGS. 1 and 2). The spring 53 on the crank 57, biases the closed end of the U-shaped ejector upwardly into the opening 25 at the rearward side of the socket 5, so that the head of the T-shaped projection 45 is above the upper surfaces of the ejector guides 29 at the bottom 11 of the socket. Upon actuation of the solenoid 55, the plunger 59 moves upwardly thereby pivoting the crank 57 forward and moving the ejector 9 forward away from its retracted position (see FIGS. 3 and 4). As the ejector moves forward, the head of the T-shaped projection 45 engages the rear of the bottom coin 19 and the stem of the T-shaped projection extends in the central slot 27 between the ejector guides 29. At some point along the forward movement of the T-shaped projection over the bottom 11 of the socket 5, the bias of the spring 53 on the ejector changes from an upwardly directed one to a downwardly directed one. When the T-shaped projection moves past the forward edge 23 of the bottom 11 of the socket 5, the ejector 9 rapidly pivots down under the bias of the spring 53 to its normally biased angular position relative to the crank 57 (see FIG. 5). The down swing of the ejector 9 helps eject the bottom coin 19 out of the bottom-opening recess 33 of the base 3. At the same time, the forward edge of the coin 19 engages the inclined surface 33 of the top 31 of the base 3 and is deflected down. Since the forward end of the ejector member 43 is open and wider than the coin 19, the coin 19 can not become jammed between the inclined surface and the ejector member 43. After ejecting the coin and upon deenergizing of the solenoid, the bias of the spring 62 causes the crank 57 to pivot rearwardly and the ejector 9 to move rearwardly toward its retracted position. The spring 53 maintains the ejector 9 in its biased angular position relative to the crank 57 during an initial portion of the rearward movement of the crank 57. At some point along the rearward movement of the ejector 9, however, the top surface of the T-shaped projection 45 slidingly engages the lower surface of the bottom 11 of the socket 5 and a force biasing the ejector upwardly is developed in the spring 53. Upon the T-shaped projection moving rearwardly past the rearward edge of the bottom 11 of the socket 5, the spring 53 pivots the ejector 9 up within the opening 25 to its retracted position. Upon ejecting the bottom coin 19, the stack 17 of coins moves down so that a new bottom coin bears on the bottom 11 of the socket 5 and is ready to be ejected.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Coin dispensing apparatus comprising:

a base having a socket therein adjacent one end of the base constituting its rearward end, said socket being adapted to receive a tube for holding a stack of coins to be dispensed, the bottom coin of the stack bearing on the bottom of the socket for supporting the stack of coins;

an exit passage at the forward side of the socket for ejection of said bottom coin by sliding it forward off the bottom of the socket, the bottom of the socket having a forward edge at the forward side of the socket, the bottom of the socket also having an opening adjacent the rearward side of the socket and a central slot narrower than said opening extending forward from said opening to said forward edge of the bottom of the socket;

said base having a bottom-opening recess forward of the socket into which the bottom coin slides as it is ejected, the coin dropping down out of said recess, a coin ejector at the bottom of the socket movable forward away from a retracted position for ejecting the bottom coin, and means for moving the ejector forward for ejecting the bottom coin and rearward back to said retracted position, the ejector comprising a U-shaped member extending beneath the bottom of the socket and movable between a raised position toward the bottom of the socket and a lowered position away from the bottom, the U-shaped member opening toward the forward end of the base and having a T-shaped projection extending up from a central portion of its closed end, said projection being engageable with the rear of said bottom coin and comprising a stem adapted to extend up within said central slot when the ejector moves forward from its retracted position and a head at the upper end of the stem, the U-shaped member being in raised position with the head thereon being above the bottom of the socket when the ejector moves forward, the U-shaped member being in lowered position with the head thereon being below the bottom of the socket when the ejector moves rearward, the U-shaped member at its open end being wider than the coin to be ejected.

2. Coin dispensing apparatus comprising:

a base having a socket therein adjacent one end of the base constituting its rearward end, said socket being adapted to receive a tube for holding a stack of coins to be dispensed, the bottom coin of the stack bearing on the bottom of the socket for supporting the stack of coins;

an exit passage at the forward side of the socket for ejection of said bottom coin by sliding it forward off the bottom of the socket, the bottom of the socket having a forward edge at the forward side of the socket, the bottom of the socket also having an opening adjacent the rearward side of the socket and a central slot narrower than said opening extending forward from said opening to said forward edge of the bottom of the socket;

said base having a bottom-opening recess forward of the socket into which the bottom coin slides as it is ejected, the coin dropping down out of said recess, said base further having a top over said bottom-opening recess, said top having an inclined surface at the forward end of the base, said inclined surface being engageable by the forward edge of said bottom coin and deflecting said coin downwardly as the coin is ejected, a coin ejector at the bottom of the socket movable forward away from a retracted position for ejecting the bottom coin, and means for moving the ejector forward for ejecting the bottom coin and rearward back to said retracted position, the ejector comprising a U-shaped member opening toward the forward end of the base and having an upstanding T-shaped projection at a central portion of its closed end, said projection being engageable with the rear of said bottom coin and comprising a stem adapted to extend up within said central slot when the ejector moves forward from its retracted position and a head at the upper end of the stem, the head being above the bottom of the socket when the ejector moves forward, and being below the bottom of the socket when the ejector moves rearward, the U-shaped member at its open end being wider than the coin to be ejected.

3. Coin dispensing apparatus as set forth in claim 2 wherein said top also has a generally horizontal surface extending between the inclined surface and the exit passage, said top further having two side slots therein.

4. Coin dispensing apparatus as set forth in claim 3 wherein said U-shaped member further comprises a pair of arms extending upwardly through the side slots in said top of the base, one arm extending from each side of the U-shaped member at said open end thereof, said arms being pivotally connected to said means for moving the ejector.

5. Coin dispensing apparatus comprising:

a base having a socket therein adjacent one end of the base constituting its rearward end, said socket being adapted to receive a tube for holding a stack of coins to be dispensed, the bottom coin of the stack bearing on the bottom of the socket for supporting the stack of coins;

an exit passage at the forward side of the socket for ejection of said bottom coin by sliding it forward off the bottom of the socket, the bottom of the socket having a forward edge at the forward side of the socket, the bottom of the socket also having an opening adjacent the rearward side of the socket and a central slot narrower than said opening extending forward from said opening to said forward edge of the bottom of the socket;

said base having a bottom-opening recess forward of the socket into which the bottom coin slides as it is ejected, the coin dropping down out of said recess, a coin ejector at the bottom of the socket movable forward away from a retracted position for ejecting the bottom coin, and means for moving the ejector forward for ejecting the bottom coin and rearward back to said retracted position, said base having a side plate extending up from one side of the base, said means for moving the ejector comprising a solenoid secured to the side plate and a crank pivotally mounted on the side plate for pivotal movement about a horizontal axis forwardly away from a retracted position, the crank, upon being swung forward, moving the ejector forward away from its retracted position, the ejector comprising a U-shaped member opening toward the forward end of the base and having an upstanding T-shaped projection at a central portion of its closed end, said projection being engageable with the rear of said bottom coin and comprising a stem adapted to extend up within said central slot when the ejector moves forward from its retracted position and a head at the upper end of the stem, the head being above the bottom of the socket when the ejector moves forward, and being below the bottom of the socket when the ejector moves rearward, the U-shaped member at its open end being wider than the coin to be ejected.

6. Coin dispensing apparatus as set forth in claim 5 wherein said means for moving the ejector further comprises means for biasing the crank rearward to its retracted position, the crank, upon being swung rearward toward its retracted position, moving the ejector rearward to its retracted position.

7. Coin dispensing apparatus as set forth in claim 6 wherein the ejector and a plunger of the solenoid are pivotally connected to the crank, the crank swinging forward upon energization of the solenoid.

8. Coin dispensing apparatus as set forth in claim 7 wherein said means for moving the ejector further comprises a spring secured at one end thereof to the crank and engageable at a second end thereof with the ejector for biasing the ejector to a predetermined angular position relative to the crank, said spring biasing the ejector to a raised position so that the head of the projection of the ejector extends upwardly into the opening adjacent the rearward side of the socket when the bell crank moves the ejector into its retracted position, the spring biasing the ejector to a lowered position so that the head is below the bottom of the socket, when the bell crank moves the ejector forward past the forward edge of the bottom of the socket.

9. Coin dispensing apparatus as set forth in claim 8 wherein said means for moving the ejector further comprises a stop for blocking forward movement of said bottom coin through the exit passage when the crank is in its retracted position, said stop unblocking the exit passage as the crank pivots forward.

10. Coin dispensing apparatus as set forth in claim 9 wherein said stop comprises a lug extending downwardly from said crank, said lug having a rearward edge engageable by the forward edge of the bottom coin when the stop is in its retracted position.

11. A coin dispensing apparatus as set forth in claim 10 wherein said base has a top over said bottom-opening recess, the top having an inclined surface at the forward end of the base and a generally horizontal surface between the inclined surface and the exit passage, said inclined and horizontal surfaces having a central slot therein extending forwardly from the exit passage, said lug extending within said central slot in the top.

12. Coin dispensing apparatus as set forth in claim 1 wherein the coin tube is one of a number of tubes of different internal diameters for holding coins of different diameters, the tube and socket have interengaging means for holding the lower end of the tube in the socket, so as to position the rear of the coins in the tube at said opening adjacent the rearward side of the socket.

13. Coin dispensing apparatus comprising:

a base having a socket therein adjacent one end of the base constituting its rearward end, said socket being adapted to receive a tube for holding a stack of coins to be dispensed, the bottom coin of the stack bearing on the bottom of the socket for supporting the stack of coins;

an exit passage at the forward side of the socket for ejection of said bottom coin by sliding it forward off the bottom of the socket, the bottom of the socket having a forward edge at the forward side of the socket, the bottom of the socket also having an opening adjacent the rearward side of the socket and a central slot narrower than said opening extending forward from said opening to said forward edge of the bottom of the socket;

said base having a bottom-opening recess forward of the socket into which the bottom coin slides as it is ejected, the coin dropping down out of said recess, a coin ejector at the bottom of the socket movable forward away from a retracted position for ejecting the bottom coin, and means for moving the ejector forward for ejecting the bottom coin and rearward back to said retracted position, the ejector comprising a U-shaped member opening toward the forward end of the base and having an upstanding T-shaped projection at a central portion of its closed end, said projection being engageable with the rear of said bottom coin and comprising a stem adapted to extend up within said central slot when the ejector moves forward from its retracted position and a head at the upper end of the stem, the head being above the bottom of the socket when the ejector moves forward, and being below the bottom of the socket when the ejector moves rearward, the U-shaped member at its open end being wider than the coin to be ejected, the coin tube being one of a number of tubes of different internal diameters for holding coins of different diameters, the tube and socket have interengaging means for holding the lower end of the tube in the socket, so as to position the rear of the coins in the tube at said opening adjacent the rearward side of the socket, the tube having an opening at its rearward side sized to enable the head of the projection to move therethrough and an opening at its forward side sized to enable the bottom coin and the head of the projection to move therethrough upon the ejector moving forward to eject the bottom coin.

14. Coin dispensing apparatus comprising:

a base having a socket therein adjacent one end of the base constituting its rearward end, said socket being adapted to receive a tube for holding a stack of coins to be dispensed, the bottom coin of the stack bearing on the bottom of the socket for supporting the stack of coins, the coin tube being one of a number of tubes of different internal diameters for holding coins of different diameters, the tube and socket have interengaging means for holding the lower end of the tube in the socket, so as to position the rear of the coins in the tube at said opening adjacent the rearward side of the socket;

further comprising coin positioning means comprising a projection on the interior wall of the tube, said projection being engageable with the forward edge of the coin immediately above said bottom coin for positioning the forward edge of said coin above said bottom coin rearwardly of the forward edge of said bottom coin, thereby preventing engagement of the rims at the forward edges of these coins upon ejecting said bottom coin, an exit passage at the forward side of the socket for ejection of said bottom coin by sliding it forward off the bottom of the socket, the bottom of the socket having a forward edge at the forward side of the socket, the bottom of the socket also having an opening adjacent the rearward side of the socket and a central slot narrower than said opening extending forward from said opening to said forward edge of the bottom of the socket;

said base having a bottom-opening recess forward of the socket into which the bottom coin slides as it is ejected, the coin dropping down out of said recess, a coin ejector at the bottom of the socket movable forward away from a retracted position for ejecting the bottom coin, and means for moving the ejector forward for ejecting the bottom coin and rearward back to said retracted position, the ejector comprising a U-shaped member opening toward the forward end of the base and having an upstanding T-shaped projection at a central portion of its closed end, said projection being engageable with the rear of said bottom coin and comprising a stem adapted to extend up within said central slot when the ejector moves forward from its retracted position and a head at the upper end of the stem, the head being above the bottom of the socket when the ejector moves forward, and being below the bottom of the socket when the ejector moves rearward, the U-shaped member at its open end being wider than the coin to be ejected.

15. Coin dispensing apparatus as set forth in claim 14 wherein said coin positioning means further comprises an inclined projection on the interior surface of the socket at its rearward side.

16. Coin dispensing apparatus as set forth in claim 13 wherein said tube at its lower end has a spring finger extending into said opening at said forward side of the tube, said finger bearing on the top of said bottom coin for biasing said coin down into engagement with the bottom of the socket, when said bottom coin is moved forward over the bottom of the socket.

* * * * *